United States Patent [19]

Balke et al.

[11] Patent Number: 4,858,545

[45] Date of Patent: Aug. 22, 1989

[54] SEWING MACHINE HAVING MEANS FOR TERMINATING SEAMS AT A PREDETERMINED PLACE

[75] Inventors: Siegmund Balke, Spenge; Günter Lütkemeyer, Bielefeld, both of Fed. Rep. of Germany

[73] Assignee: Durkoppwerke GmbH, Fed. Rep. of Germany

[21] Appl. No.: 52,717

[22] Filed: May 21, 1987

[30] Foreign Application Priority Data

May 22, 1986 [DE] Fed. Rep. of Germany ..... 3617204

[51] Int. Cl.[4] ..... D05B 69/22

[52] U.S. Cl. ..... 112/275; 112/315; 112/121.11

[58] Field of Search ..... 112/275, 277, 315, 272, 112/121.11, 314, 2, 306, 114

[56] References Cited

U.S. PATENT DOCUMENTS

| | | | |
|---|---|---|---|
| 4,491,080 | 1/1985 | Hager | 112/275 |
| 4,495,877 | 1/1985 | Willenbacher | 112/275 X |
| 4,583,476 | 4/1986 | Fischer | 112/275 |
| 4,706,584 | 11/1987 | Senda et al. | 112/275 X |
| 4,722,291 | 2/1988 | Goto | 112/275 X |

*Primary Examiner*—Peter Nerbun

*Attorney, Agent, or Firm*—Ostrolenk, Faber, Gerb & Soffen

[57] ABSTRACT

A sewing machine adapted for moving a workpiece in a downstream direction for sewing a seam therein, and for automatically terminating the seam at a predetermined point a selected distance from a trailing edge of the workpiece. An edge sensor on a base is located a predetermined distance upstream of the sewing point for sensing the downstream passage of the trailing edge, and generating edge sensing signals in response thereto. A stroke sensor on the base senses the length of the strokes of the feed dog and generates stroke length signals which are indicative of the stroke length and of the length of the stitches. A stopping device is provided on the base for being actuated to engage the workpiece to stop its movement when the sewing needle is at the predetermined point for terminating the seam; and a control system receives the edge sensing signals and the stroke length signals, determines therefrom a time when the sewing needle will be at the predetermined point, and generates a stopping signal for actuating the stopping device at that time.

28 Claims, 10 Drawing Sheets

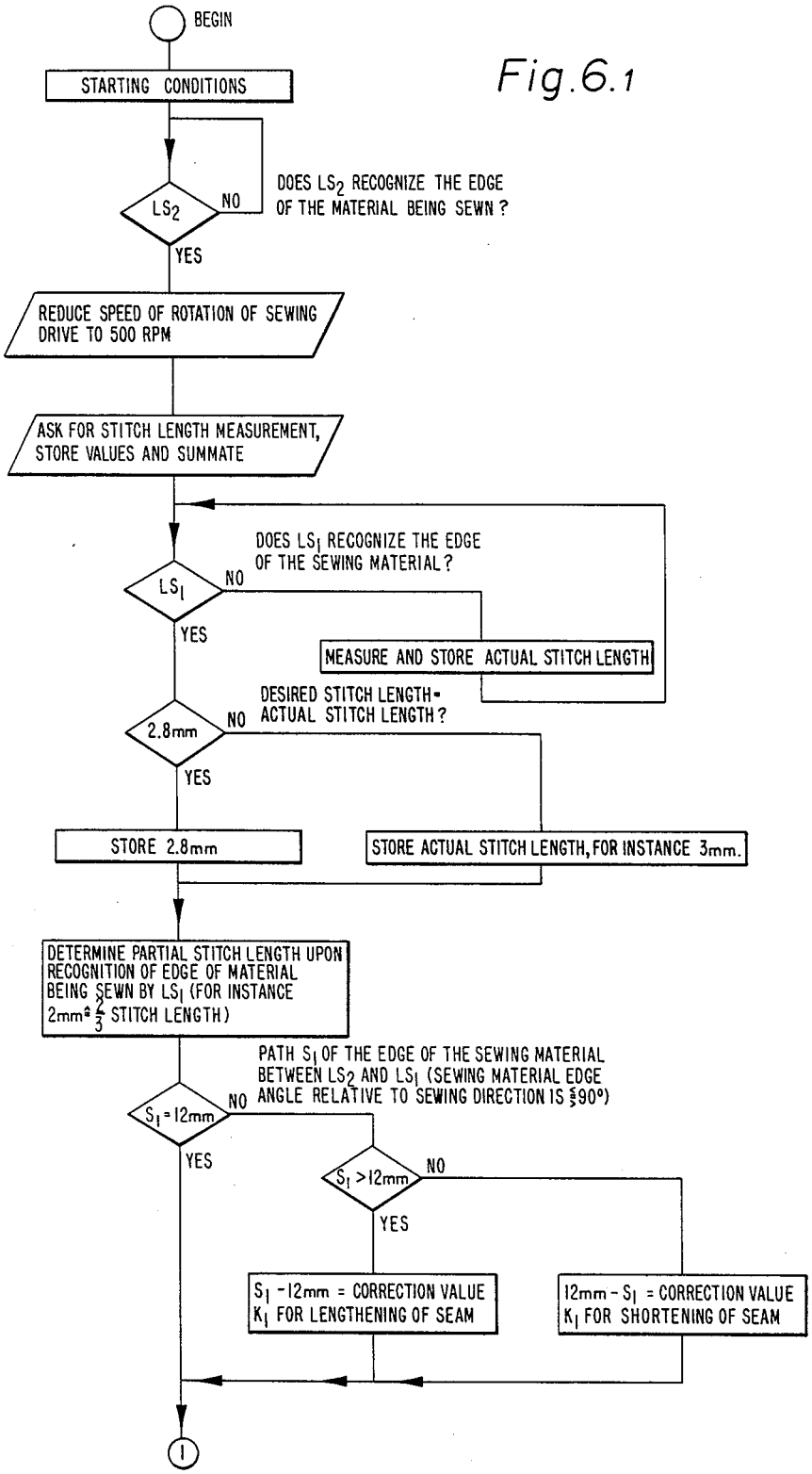
BEGIN
STARTING CONDITIONS
Fig.6.1
LS2
NO
DOES LS2 RECOGNIZE THE EDGE OF THE MATERIAL BEING SEWN ?
YES
REDUCE SPEED OF ROTATION OF SEWING DRIVE TO 500 RPM
ASK FOR STITCH LENGTH MEASUREMENT, STORE VALUES AND SUMMATE
DOES LS1 RECOGNIZE THE EDGE OF THE SEWING MATERIAL ?
LS1
NO
YES
MEASURE AND STORE ACTUAL STITCH LENGTH
DESIRED STITCH LENGTH = ACTUAL STITCH LENGTH ?
2.8mm
NO
YES
STORE 2.8mm
STORE ACTUAL STITCH LENGTH, FOR INSTANCE 3mm.
DETERMINE PARTIAL STITCH LENGTH UPON RECOGNITION OF EDGE OF MATERIAL BEING SEWN BY LS1 (FOR INSTANCE 2mm ≙ 2/3 STITCH LENGTH)
PATH S1 OF THE EDGE OF THE SEWING MATERIAL BETWEEN LS2 AND LS1 (SEWING MATERIAL EDGE ANGLE RELATIVE TO SEWING DIRECTION IS ≦90°)
S1 = 12mm
NO
YES
S1 > 12mm
NO
YES
S1 - 12mm = CORRECTION VALUE K1 FOR LENGTHENING OF SEAM
12mm - S1 = CORRECTION VALUE K1 FOR SHORTENING OF SEAM
1

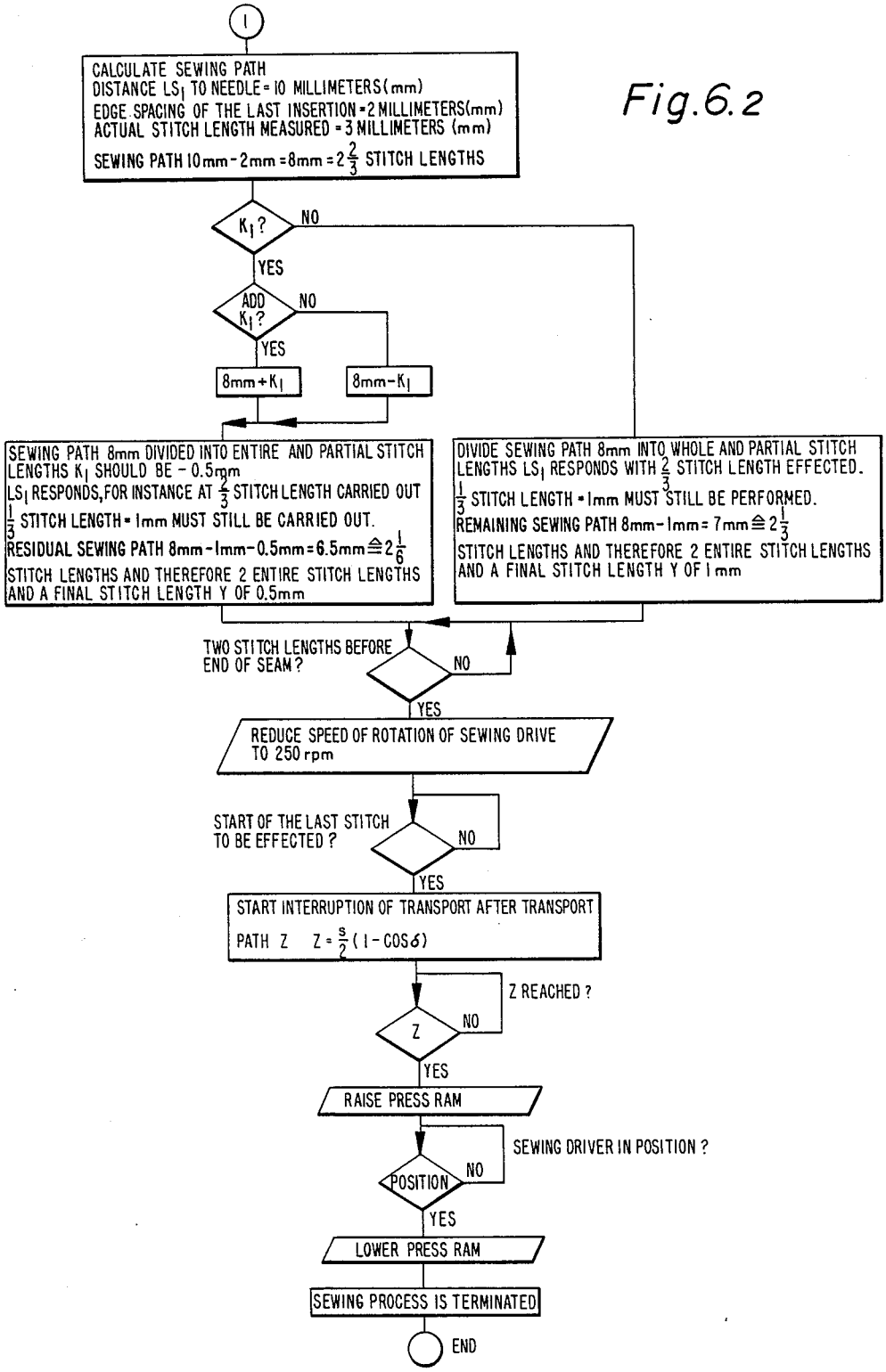
Fig. 6.2

FIG. 8
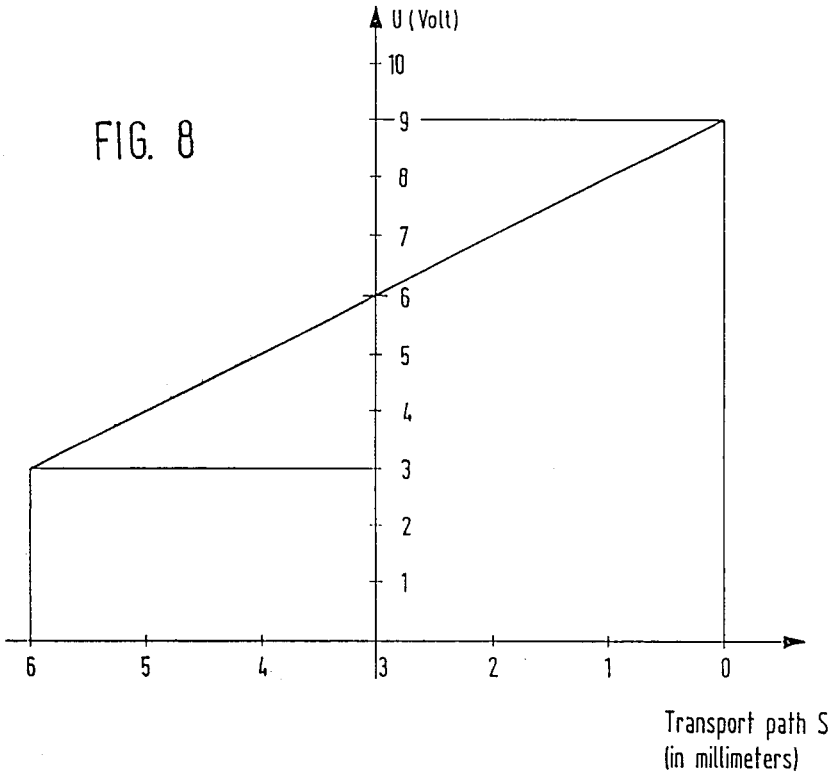
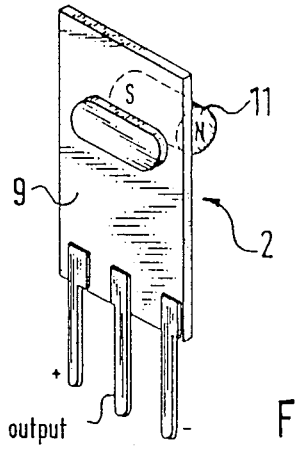
FIG. 9

SEWING MACHINE HAVING MEANS FOR TERMINATING SEAMS AT A PREDETERMINED PLACE

BACKGROUND OF THE INVENTION

1. Field of the Invention

The present invention relates to a sewing machine, and more particularly to a sewing machine with means including sensors and electronic controls for producing seams which terminate at a predetermined point or location.

2. Description of Related Art

The following methods have been used for a long time in the sewing industry for locating the last needle insertion of a seam at a predetermined place, such place being determined as a desired given distance from the edge of the material being sewn:

a) After visual detection of the edge, the sewing machine may be stopped at a suitable moment, the sewing needle being in raised position. Thereupon the presser foot is brought into its raised position. The piece being sewn in then moved by hand in such a manner that the following needle insertion strikes the predetermined place.

b) After visual detection of the edge, the sewing machine may be stopped at a suitable time at which the sewing needle is in raised position while the presser foot remains down. The stitch regulator is now actuated by hand in such a manner that the sewing needle points to the predetermined place. The last stitch is then performed.

Both methods are time consuming since the method steps to be performed must be carried out by the eye, the brain and the hands of the operator. A more rational manner of operation would be desirable, in which the method steps are carried out automatically by the sewing machine.

Such a sewing machine is known from West German Pat. No. 31 50 141. In that example, the sewing needle is stopped at a predetermined point in the material being sewn, either at the end of the seam, or at a point which is characterized by an interruption of the seam or by a change in direction of the seam. For this purpose the known sewing machine is equipped essentially with a sensor which is arrange din front of the sewing needle and scans the edge of the material being sewn. An electronic control executes program instructions for the exact positioning of the last needle insertion. A potentiometer is fastened at the end of the setting shaft, from the angular position of which dependent values can be obtained which represent the length of stitch set. A pulse transmitter acts during the advancing phase of the feed dog and in cooperation with the aforementioned potentiometer, to give information as to the present state of advance of the stitch which has just been produced. An electromagnetically actuatable multi-member parallel-crank transmission permits a temporary lowering of the feed dog into a position which is inactive for the transport of the material being sewn.

This known sewing machine has the following disadvantages:

1. In order to be able to influence the length of the last stitch, two pick-ups are necessary, namely a potentiometer which represents the stitch length set in measurement values and a rotary pulse transmitter provided in the lower shaft and which breaks down the length of stitch set into partial lengths, whereby the latter become countable.

2. Since various levers are arranged behind the potentiometer and have unavoidable play and elasticity, the transport path moved over by the feed dog is dependent on the speed of sewing and is not necessarily proportional to the measurement value of the potentiometer.

3. The transport path of the feed dog which has been moved over is related to the angle of rotation of the associated rotary pulse transmitter by a trigonometric function. If one assumes that the graduations on the disk of the rotary pulse transmitter are, as is customary, a uniform distance apart, then measurement errors occur due to the fact that at the start and at the end of each forward step smaller transport paths per angle of rotation are moved over, and in the central part of the forward step longer transport paths per angle of rotation are moved over. The measurement errors resulting from this non-linear relationship must be accepted in the known sewing machine.

4. The parts necessary for the sudden lowering of the feed dog increase the structural cost, and when they move cause forces of inertia which can have an unfavorable effect on the kinematics of the feed dog.

5. The piece being sewn which is held between the smooth top side of the throat plate and the smooth bottom side of the presser foot when the feed dog is lowered is not held in stable position when pulling forces are exerted on the piece being sewn.

SUMMARY OF THE INVENTION

The invention has the principal object of providing a device which avoids the disadvantages of the state of the art as set forth above.

A further object is to permit a direct measurement of the stitch length directly at the feed dog by means of only one distance sensor.

Another object is to control the location of the last stitch to be carried out, in order to terminate a seam at a predetermined point, without adversely affecting the feed dog.

Still another object is to provide a device for terminating a seam at a predetermined point while holding the workpiece fast, and not permitting any further displacement thereof.

In accordance with one aspect of the invention, these objects are achieved by a sewing machine adapted for moving a workpiece in a downstream direction for sewing a seam therein, and for automatically terminating the seam at a predetermined point a selected distance from a trailing edge of the workpiece. The sewing machine comprises base means and arm means mounted on the base means. Drive means is provided which drives a sewing needle movably mounted on the arm means to make stitches at a sewing point on the base means. The drive means also actuates a feed dog adjacent to the sewing point on the base means to cause it to perform repetitive strokes to move the workpiece past the sewing point in the downstream direction. Edge sensing means on the base means, located a predetermined distance upstream of the sewing point, senses the downstream passage of the trailing edge, and generates edge sensing signals in response thereto. Stroke sensing means is provided on the base means for sensing the length of the strokes of the feed dog and generating stroke length signals which are indicative of the stroke length and of the length of the stitches. There is also stopping means on the base means for being actuated to engage the workpiece to stop its movement when the sewing needle is at the predetermined point for terminating the seam. Control means receives the edge sensing signals and the stroke length signals, determines therefrom a time when the sewing needle will be at the predetermined point, and generates a stopping signal for actuating the stopping means at that time.

Another aspect of the invention relates to a stitch length sensing system for a sewing machine adapted for moving a workpiece in a downstream direction for sewing a seam therein. The sewing machine comprises base means and arm means mounted on the base means. Drive means is provided for driving a sewing needle, the sewing needle being movably mounted on the arm means to make stitches at a sewing point on the base means. The drive means also drives a feed dog on the base means adjacent the sewing point which engages the workpiece and performs repetitive strokes, thereby moving the workpiece past the sewing point in the downstream direction. The stitch length sensing system comprises stroke sensing means on the base means for sensing the length of the strokes of the feed dog and generating stroke length signals which are indicative of the stroke length, and thereby sensing the length of the stitches.

A further aspect of the invention relates to an edge sensing system for a sewing machine adapted for moving a workpiece in a downstream direction for sewing a seam therein, the sewing machine comprising base means; arm means mounted on the base means; and drive means, for driving a sewing needle, said sewing needle being movably mounted on the arm means to make stitches at a sewing point on the base means, said drive means also driving a feed dog on the base means adjacent the sewing point which engages the workpiece and performs repetitive strokes, thereby moving the workpiece past said sewing point in said downstream direction. The edge sensing system comprises edge sensing means on the base means, located a predetermined distance upstream of said sewing point for sensing the downstream passage of such trailing edge, and generating edge sensing signals in response thereto.

Still another aspect of the invention relates to a workpiece stopping system for a sewing machine adapted for moving a workpiece in a downstream direction for sewing a seam therein, and for terminating said seam at a predetermined point, the sewing machine comprising base means; arm means mounted on the base means; and drive means, for driving a sewing needle, said sewing needle being movably mounted on the arm means to make stitches at a sewing point on the base means, said drive means also driving a feed dog on the base means adjacent the sewing point which engages the workpiece and performs repetitive strokes, thereby moving the workpiece past said sewing point in said downstream direction. The workpiece stopping system comprises stopping means on the base means for being actuated to engage the workpiece to stop its movement when the sewing needle is at the predetermined point for terminating the seam; and control means for detecting a time when the sewing needle will be at said predetermined point, and generating a stopping signal for actuating the stopping means at said time.

With a device embodying the invention, it is now possible to effect a direct measurement of the stitch length in the immediate vicinity of the stitching, as a result of which the stitch length is determined exactly.

Another advantage, of the direct measurement of the length of stitch relates to the changes in the transport distance of the feed dog that are caused by different speeds of sewing. Such changes occur, for example, as a result of bearing play in the feed dog and associated mechanisms at higher speeds. These changes are sensed directly, and corrections are brought about by means of the electronic control circuit, so that the length of stitch may change as a function of sewing speed without changing the length of the seam being sewn.

Further, the device of the invention provides for the piece being sewn to be temporarily halted by being raised upward in a region adjacent to the continuously moving feed dog, to such an extent that the toothing of the feed dog cannot grip the piece being sewn.

BRIEF DESCRIPTION OF THE DRAWINGS

Other objects, features and advantages of the invention will be seen in the following detailed description of an embodiment thereof, with reference to FIGS. 1 to 8, in which:

FIGS. 6.1 and 6.2 are flow charts illustrating one example of the operation of the disclosed embodiment of the invention, a sequence of functions being set forth beginning with the first scanning of the trailing edge of the material being sewn, and up to the interruption of the seam;

FIG. 8 is a diagram showing the output voltage change of the Hall sensor over the path of the feed dog; and FIG. 9 is a perspective view of a Hall sensor and associated permanent magnet which may be employed with the invention.

DETAILED DESCRIPTION

Figure 1:
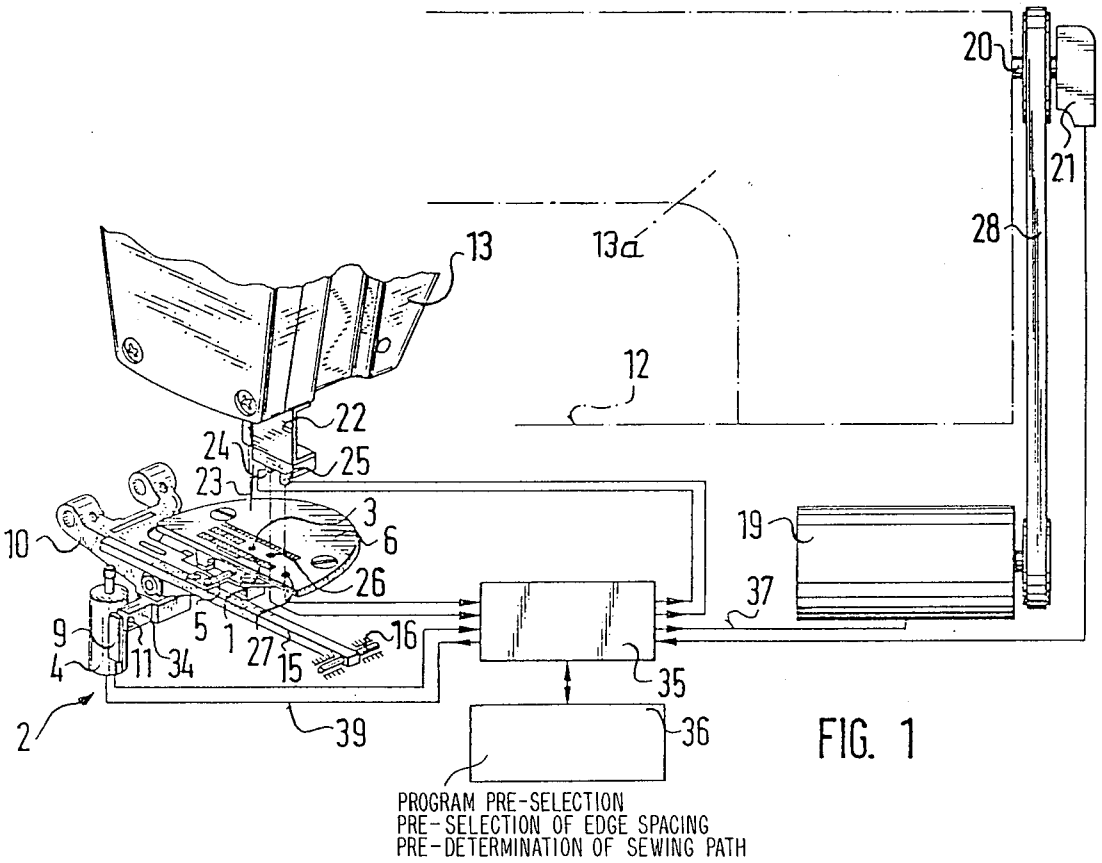
FIG. 1 is a schematic diagram of a sewing machine including a seam-terminating device according to an embodiment of the invention.

FIG. 1 is a schematic view of a sewing machine having an upper part 13a fastened to a base plate 12. The sewing machine 13 is driven is known fashion by a positioning drive 19 via a V-belt 28. At the end of an arm shaft 20, which is merely schematically indicated here, there is arranged a known position sensor 21, specifically an incremental pulse transmitter.

First and second transmitters 24, 25 are fastened to an angle iron 22 so as to depend from the arm head 13 of the sewing machine a defined distance in front of the sewing needle 23. As used herein, "front" refers to a direction toward the operator, i.e., opposite to the direction of transport NV of the material being sewn, as seen in FIG. 5. The transmitters 24, 25 are mounted on a horizontal plate 40, which is turn is secured to the angle iron 22. With the first transmitter 24 there is associated a first sensor 26 which is mounted in the throat plate 6, the first transmitter 24 and the first sensor 26 being aligned vertically along a line that intersects the throat plate 6 a predetermined distance in front of the sewing needle insertion point 3. A second sensor 27, also mounted in the throat plate 6, is associated and aligned vertically with the second transmitter 25, the sensor 27 being located in front of the first sensor, but at a defined distance to one side of the sewing needle insertion point 3.

The combination of the transmitter 24 and the sensor 26 is designated LSl in FIG. 5; and the combination of the transmitter 25 and the sensor 27 is designated LS2. Each of these transmitter-sensor pairs LSl, LS2 operates together as a so-called one-way light barrier.

Figure 2:
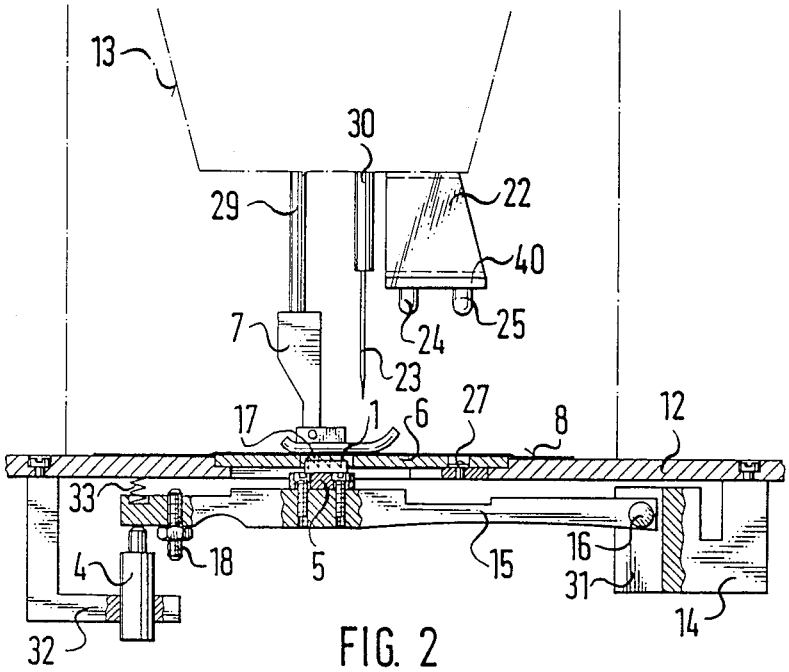
FIG. 2 is a simplified sectional view of the vicinity of the sewing point with the press ram in its lower position, and not showing the stroke sensor.
Figure 3:
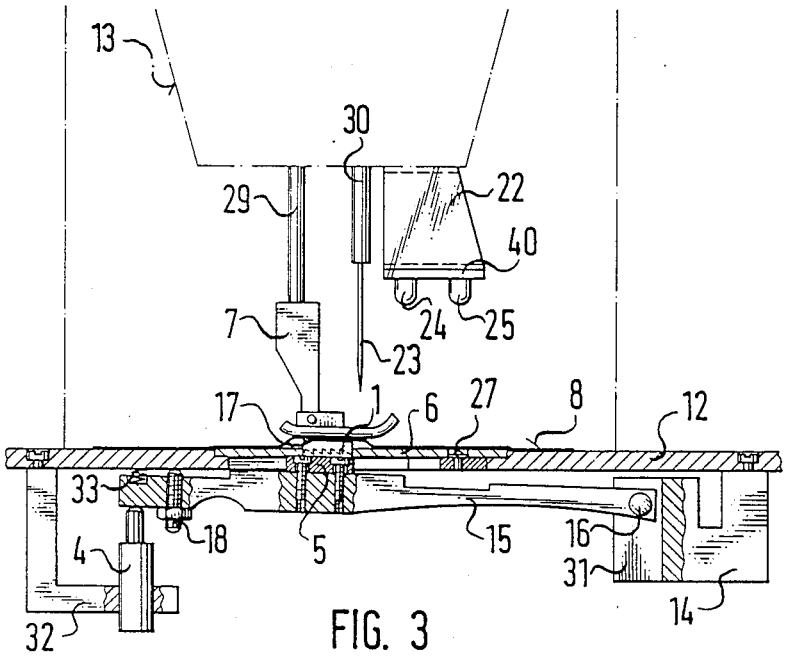
FIG. 3 is a simplified sectional view similar to FIG. 2, with the press ram in its upper position.

A workpiece 8 being sewn is retained during sewing between a presser foot 7 and the throat plate 6, and is transported stepwise in a known manner by a skipping feed dog 1. The latter is mounted on a support beam 10. For reasons of clarity, in FIGS. 1 to only the parts in the vicinity of the sewing point which are directly related to the object of the invention are shown, while other parts, for instance the looper, the thread cutter and the parts necessary for the movement of the feed dog 1, have been omitted. The throat plate 6 is fastened, as shown in FIGS. 2 and 3, to the base plate 12. In the arm head 13 of the sewing machine there is provided, in a known manner, a presser bar 29 and a needle bar 30. The needle bar 30 receives the sewing needle 23 while the presser foot 7 is fastened to the presser bar 29.

On the bottom of the base plate 12 toward the front there is fastened a bearing bracket 14 which has a rear-facing vertical slit 31. This slit receives a lever 15 which is swingable in a vertical plane around a pivot point 16. Beneath the other (rear) end of the lever 15 there is located a servo-element 4 which in the embodiment shown comprises a cylinder and a solenoid valve (not shown), the cylinder being mounted in a clamping bracket 32 fastened to the bottom of the base plate 12. By loosening the clamp connection between the bracket 32 and the cylinder, the servo-element 4 may be adjusted in height. The cylinder may be of a type which can be actuated by pressure fluid, or a compressed air cylinder, or an electromagnet, for example.

When actuated, the servo-element 4 temporarily engages the bottom of the lever 15. On the top of the lever 15, opposite the surface of attack of the servo-element 4 thereon, a compression spring 33 is form-locked to the lever 15, the other end of the compression spring 33 resting against the bottom of the base plate 12. An adjustable stop 18 is furthermore provided on the lever 15 for setting a minimum spacing between the lever 15 and the base plate 12.

Figure 4:
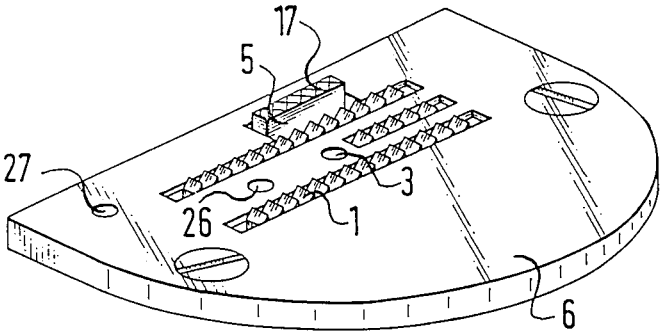
FIG. 4 is a perspective view of the throat plate with the press ram in raised position extending above the toothing of the feed dog.

On the top of the lever 15 there is fastened a press ram 5 which, as shown in FIGS. 1 and 4, is located in the vicinity of the location of sewing, specifically in the vicinity to one side of the point of insertion 3 of the sewing needle 23 and which, after activation of the servo-element 4, passes upward through the throat plate 6. When this occurs, the presser foot 7 is pushed upward by the press ram 5 a distance which is dependent on the setting of the stop 18. A pressure surface 17 which is toothed, or roughened in some other manner, extends in the elevated position of the press ram 5 above the tooth crests of the feed dog 1 (see FIGS. 3 and 4).

For the exact measurement of the stitch length, a stroke sensor 2 is provided in the direct vicinity of the feed dog 1. The stroke sensor 2 comprises a linear Hall effect sensor 9, which is fixed in position by any suitable means, and a bar-shaped permanent magnet 11, preferably a samarium-cobalt magnet, which is fastened to the feed dog 1 or its support beam 10. The direction of magnetization lies in the direction of the horizontal component of the movement of the feed dog 1. By the motion of the feed dog 1, the permanent magnet 11 may move as much as about 6 mm in front of the Hall sensor 9. In order to avoid a magnetic shunt, the permanent magnet 11 is preferably bonded to a plastic holding part 34 which in turn is secured to the support beam 10. The distance between the portion of the Hall sensor 9 which faces the permanent magnet 11, and the portion of the permanent magnet 11 closest to it, may be about 0.5 mm. In order to maintain this spacing, this portion of the permanent magnet 11 should, as far as possible, be lined up with the corresponding front portion of the holding part 34.

The input elements (sensors 26 and 27, Hall sensor 9, and position sensor 21) and the output elements (positioning drive 19, transmitters 24 and 25, and servo-element 4) are interconnected by an electronic control circuit 35. The latter cooperates furthermore with an input and display station shown schematically at 36, while comprises keys, switches, multi-digit selector switches and display elements, said station providing for the manual input of data for preselecting the program, preselecting the edge spacing, and predetermining the sewing path, and providing visual displays of measurement data.

Figure 5A:
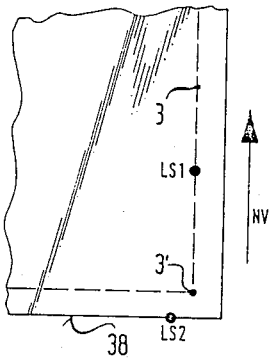
FIGS. 5A, 5B and 5C are plan views showing the corners of three types of workpiece that may be sewn with the invention, the corners defining different seam angles.
Figure 5B:
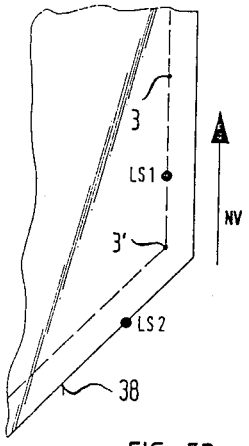
Figure 5C:
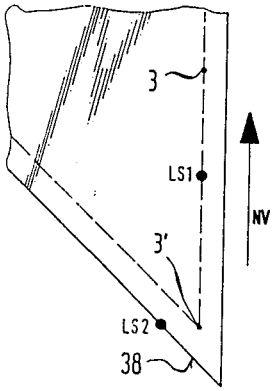

An example of the operation of the apparatus for the production of corner seams will now be described, with reference to FIGS. 5A–5C.

When the light barrier LS2, comprising the transmitter 25 and the sensor 27, recognizes the passage of an edge 38 of a workpiece 8, which edge extends generally transverse to the transport direction NV of the material being sewn (see FIGS. 5A–5C), then the positioning drive 19 is switched, via a line 37, to a lower speed of rotation. This lower speed may be 500 rpm, for example. Furthermore, the system begins to measure the stitch length, whereby the distance over which the edge 38 moves between passing LS2 and passing LSl will be determined. In the embodiment described, the front-to-back distance between LS2 and LSl is fixed at 12 mm and the distance from LSl to the point of insertion 3 of the sewing needle at 10 mm.

When the light barrier LSl comprising the transmitter 24 and the sensor 26 detects the passage of the edge 38, it is now determined what distance in the horizontal plane was moved over by the feed dog 1 during the stitch just completed. Furthermore, the electronic control circuit 35 now determines what distance the edge 38 has moved over between passing LS2 and passing LSl. If this distance amounts to 12 mm, this indicates that the two intersecting edges (see FIG. 5A) form a right angle. If the distance determined is less than 12 mm, then the two intersecting edges form an oblique angle (see FIG. 5B). Finally, if the distance determined is greater than 12 mm, then the two intersecting edges form an acute angle (see FIG. 5C).

From this it can be seen that with only two light barriers, LS2 and LSl, it is possible to, first, initiate the reduction of the speed of rotation of the positioning drive 19, and then scan the edge 38, in order to exactly position the last insertion of the sewing needle and perform the angular measurement between two intersecting edges of the piece 8 being sewn. By means of said angle measurement, a correction value Kl is determined by the electronic control circuit 35 for the length of the last stitch to be performed (see FIG. 6.2), said value being a function of the angle formed by the two intersecting edges of the piece 8 being sewn.

In order to be able to perform the last insertion of the sewing needle precisely at the predetermined place, the following data are furthermore to be supplied to the electronic control circuit 35:

a) The desired distance of the last point of insertion 3'(see FIG. 5A) of the sewing needle 23, from the edge 38 in question, is introduced by manual input as an edge-spacing default value into the input and display station 36.

b) Before the light barrier LSl responds, the stitch length last measured is forwarded to the electronic control circuit 35.

c) The speed of rotation of the positioning drive 19 is reduced to 250 rpm by program command, two stitch lengths in front of the predetermined last sewing-needle insertion point 3'.

d) To prepare for the activating of the servo-element 4, a compensation variable K is established, by which the reaction time t from initiation of an activating electrical signal, until the clamping of the piece being sewn by the press ram 5 (see FIG. 3), is compensated for. This is effected by advancing the time of release of the servo-element 4 as a function of the transport distance that the workpiece will move over during the time t in each case.

Figure 7:
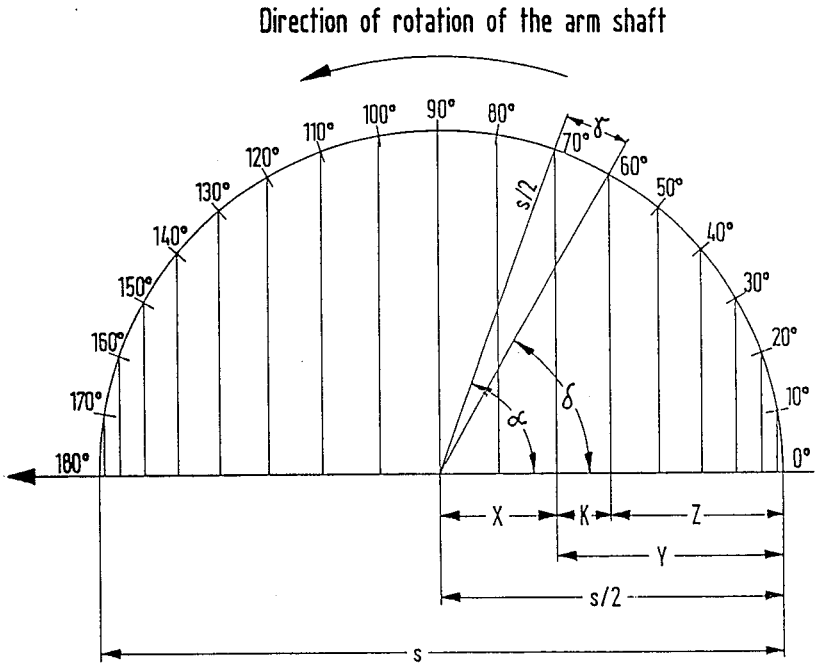
FIG. 7 is a diagram illustrating the non-linear relationship of the transport distance moved over by the feed dog as a function of the rotary movement of the arm shaft that drives it.
Figure 10:
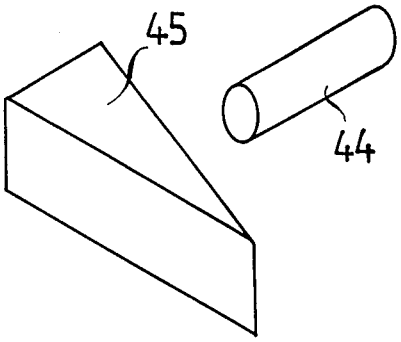
Figure 11:
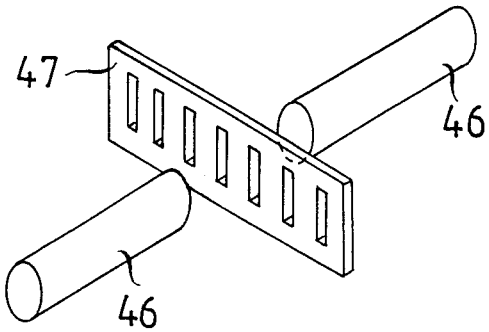

The compensation variable K is expressed as the transport distance the feed dog 1 moves in the horizontal plane, which in conjunction with the stitching rate determines the stitch length. In this connection, it is to be borne in mind that, as illustrated in FIG. 7, there is a non-linear relationship between this transport distance and the angle of rotation $\alpha$ of the arm shaft 20. The following arithmetic example shows this relationship. In this example, Y=transport distance of the feed dog 1 as a function of the angle of rotation $\alpha$, $\alpha$=angle of rotation of the arm shaft 20, and s=the total transport path moved over by the feed dog 1 in order to produce one stitch length.

As can be noted from FIG. 7, the following relationships apply:

$$X = \frac{s}{2} \times \cos\alpha \text{ and } Y = \frac{s}{2} - X.$$

From this there follows:

$$Y = \frac{s}{2} - \frac{s}{2} \times \cos\alpha \text{ or } Y = \frac{s}{2}(1 - \cos\alpha).$$

Since the speed of rotation of the positioning drive 19 directly before the activating of the servo-element 4 amounts to 250 rpm, these 250 revolutions are performed in 60 seconds or 60,000 milliseconds. Accordingly, one revolution of the arm shaft 20 takes place in 60,000/250 =240 milliseconds. Accordingly, 240/36 =6⅔milliseconds is required for an angle of rotation of 10°.

With an assumed stitch length of 3 mm, there are obtained for each 10° angle of rotation of the arm shaft 20 the transport distances Y from the start of the transport phase which are indicated in he following Table. From this Table there can furthermore be noted the non-linear relationship of the transport distance Y as a function of the angle of rotation $\alpha$, as well as the amount of the compensation variable K:

TABLE

| Angle of rotation in degrees | Time from $\alpha$= 0° in milliseconds | Transport path Y in millimeters | Compensation variable K in millimeters |
|---|---|---|---|
| 10 | 6⅔ | 0.02 | |
| 20 | 13⅓ | 0.09 | 0.07 |
| 30 | 20 | 0.20 | 0.11 |
| 40 | 26⅔ | 0.35 | 0.15 |
| 50 | 33⅓ | 0.54 | 0.19 |
| 60 | 40 | 0.75 | 0.24 |
| 70 | 46⅔ | 0.99 | 0.21 |
| 80 | 53⅓ | 1.24 | 0.25 |
| 90 | 60 | 1.50 | 0.26 |

From this Table it can be seen that the transport distance Y in the vicinity of the point of reversal of the direction of movement of the feed dog 1, for instance at $\alpha$=10°, is relatively small while Y reaches its maximum at $\alpha$=90°. For angles of more than 90° and up to 180°, corresponding values apply by analogy.

In order to explain the effect of the compensation variable K the following assumptions will be made. The edge spacing introduced into the input and display station 36 is 2 mm. The stitch length is 3 mm and the distance from LSl to the center of the sewing needle 3 is 10 mm. Of this distance, 2 mm is to be subtracted for the edge spacing, so that there results a distance of 8 mm, over which 8/3=2⅔ stitches are to occur.

If it is further assumed, for example, that at the time of the scanning of the edge of LSl two-thirds of the feed dog transport distance (one stitch length) has just been carried out, then the remainder of the 8 mm distance is divided up as follows: Two-thirds of a stitch length had already been transported when LSl responded and therefore, in order to terminate this stitch transport, another ⅓ of the stitch length=1 mm must be transported. There thus results the remaining stitch length still to be sewed of 8 mm−1 mm=7 mm. 7 mm divided into stitch lengths of 3 mm each gives 2⅓ stitches. The length of the last stitch to be effected is therefore one-third of the total stitch length, i.e., it amounts to 1 mm.

In order to achieve the shortening of this last stitch to 1 mm, the press ram 5 must press the piece 8 being sewn against the presser foot 7 precisely after a transport distance of 1 mm has occurred and it must thus raise it from the toothing of the feed dog 1 above the transport plane. In this way the feed dog 1 will no longer advance the piece 8 being sewn.

This presupposes that the reaction time t of the servo-element 4 is known. In the embodiment given by way of example, the servo-element 4 comprises a known type of solenoid valve and lift cylinder. The time which passes from applying an electrical signal to the solenoid valve until the interruption of the advancing action by the lifting of the press ram 5 by the lift cylinder amounts in this example to 7 milliseconds. This must be included in the calculation in order to be able to determine the transport distance Z at which the actuating command is to be given to the servo-element 4. The conversion of this reaction time to the transport path Y appears in the aforementioned Table as compensation variable K According to FIG. 7 and the table set forth above, the transport distance Z can be determined as follows: The interruption of the transport of the material 8 being sewn is to be carried out, as mentioned above, after a transport distance of 1 mm, which corresponds to the shortened stitch which is to be carried out last. The reaction time t of the servo-element 4 corresponds to 7 milliseconds which, with a speed of rotation of 250 rpm, corresponds to an angle of rotation of the arm shaft 20 of 10.5° . That is, the angle of rotation $\alpha$(see FIG. 7) is approximately 10° . The command for the interrupting of the transport of the material being sewn must accordingly be given, in accordance with the Table, when a transport distance Z of 0.75 mm has been traversed.

Z is determined as follows by calculation:

$\alpha$=angle of rotation of the arm shaft 20 which corresponds to the transport distance Y.

$\beta$=angle of rotation of the arm shaft 20 per unit of time.

$\gamma$=angle of rotation of the arm shaft 20 corresponding to the reaction time t of the servo-element 4.

$\delta$=angle of rotation of the arm shaft 20 which corresponds to the transport distance Z traversed before the actuation command is given to the servo-element 4.

t=reaction time of the servo-element 4.

Y=length of the shortened stitch in mm.

s=stitch length in mm.

As can be noted from FIG. 7, the following relationships apply:

$$Z = \frac{s}{2} - (X + K) \text{ and } \cos\delta = \frac{X + K}{s/2}$$

From this we have:

$$Z = \frac{s}{2} - \frac{s}{2} \times \cos\delta \text{ or } Z = \frac{s}{2}(1 - \cos\delta)$$

According to FIG. 7, the following relationships furthermore apply $$\cos\delta = \cos(\alpha - \gamma),$$

and furthermore $$\cos\alpha = \frac{X}{s/2} \text{ and } X = \frac{s}{2} - Y.$$

From the last two equations we have:

$$\cos\alpha = \frac{s/2 - Y}{s/2} \text{ or } \cos\alpha = 1 - \frac{2Y}{s}$$

$$\beta = \frac{\text{angle of rotation}}{t \quad \text{unit of time}}$$

in which $\beta$ is a synonym for the speed of rotation of the sewing machine $$\gamma = \beta + t$$

EXAMPLE

Assume s=3 mm, Y=1 mm, t=7 ms (ms=millisecond)

$$\beta = \frac{250 \text{ revolutions}}{\text{minute}} = \frac{250 \times 360°}{60 \text{ seconds}} = \frac{250 \times 360°}{60{,}000 \text{ ms}}$$

$$\beta = 1.5°/\text{millisecond}$$

-continued $$\gamma = 1.5°/\text{millisecond} \times 7 \text{ milliseconds} = 10.5°$$

$$\cos\alpha = 1 - \frac{2Y}{s} = 1 - \frac{2 \times 1}{3} = 1/3 = 0.333$$

$$\alpha = 70.53°$$

$$\cos\delta = \cos(70.53 - 10.5) = \cos(60.03)$$

$$\delta = 0.4995$$

$$Z = \frac{s}{2}(1 - \cos\delta) = \frac{3}{2}(1 - 0.4995) = 1.5 \times 0.5005$$

$$Z = 0.75075 \text{ mm}$$

After a transport distance Z=0.75 mm, the setting command for the servo-element 4 must be given in accordance with the example selected here, so it will be assured that the interruption of the transport of the material being sewn will take place precisely after a transport distance Y of 1 mm, the amount of 1 mm having been determined previously by the edge scanning effected by the light barrier LSl.

Whether the value for Z is obtained from tables established by the software, or by computation, depends on the selection of the microprocessor system which is built into the electronic control circuit 35.

An important feature for exactly positioning the point of last insertion of the sewing needle at the predetermined place in the material being sewn is the measurement of stitch length by the stroke sensor 2, which is performed in the direct vicinity of the feed dog 1. Sensor 91SS12-2 available from the Honeywell company was used in the embodiment given by way of example. For this purpose the output voltage of the Hall sensor 9 (see FIG. 9) in the embodiment given by way of example is fed to an 8-bit analog/digital converter which is located in the electronic control circuit 35.

The start of the transport of the material being sewn is indicated when the voltage at the output of the Hall sensor 9 commences to fall in accordance with the diagram of FIG. 9, starting from a maximum value, in a manner which is dependent on the stitch length. Of course, it is also possible, by reversing the polarity of the permanent magnet 11, to indicate the start of the transport of the material being sewn by a rise in the aforementioned output voltage.

Alternatively, the distance sensor 9 may be an inductive sensor which cooperates with a correspondingly shaped metal part fastened to the feed dog 1 or its supporting beam 10, the metal part being located, for example, within a high-frequency sensor field lobe developed by the inductive sensor. As a further alternative, the distance sensor 2 may be an optical sensor which generates an electrical output signal which changes as a function of the motion of the feed dog 1.

The output signal generated by the Hall sensor 9 is converted by the analog/digital converter into a range of 256 digital values which are available for processing by the electronic control circuit 35. The distance data outputted by the Hall sensor 9, the data from the light barriers LSl and LS2, and the data predetermined by the program are interrelated in accordance with the flow chart shown in FIGS. 6.1 and 6.2, which illustrate an example of a program which forms part of the software of the sewing machine in this example. The servo-element 4 is controlled over the electrical line 39 and the positioning drive 19 is controlled over the electrical line 37.

FIGS. 6.1 and 6.2 set forth an example of a process comprising a sequence of functions for completing a seam at a predetermined place in the material being sewn. In this process, the following initial conditions apply:

I. The sewing machine is sewing at 3500 stitches per minute, i.e., the arm shaft 20 has a speed of rotation of 3500 rpm;

II. The light barriers LS1 and LS2 receive measurement values continuously;

III. The preset desired stitch length is 2.8 mm;

IV. The edge spacing for the last insertion of the sewing needle is to be 2 mm;

V. The distance between LS1 and the sewing point 3 is 10 mm; and

VI. The distance between LSl and LS2 is 12 mm.

The examples described herein relate to a sewing machine having only one skipping feed dog. However, it will be apparent to skilled persons in this field that the objects of the invention can also be attained by employing the invention in a differential-transport sewing machine having two skipping bottom feed dogs, or in a sewing machine with a skipping bottom transport and a skipping top transport.

Although illustrative embodiments of the invention have been described herein, it is to be understood that the invention is not limited to such embodiments. Rather, modifications and variations thereof that may occur to one of ordinary skill in the art are considered to be within the spirit and scope of the invention, as defined in the claims.

What is claimed is:

1. A sewing machine adapted for moving a workpiece in a downstream direction for sewing a seam therein, and for automatically terminating said seam at a predetermined point a selected distance from a trailing edge of said workpiece, the sewing machine comprising:

base means;

arm means mounted on the base means;

drive means, for driving a sewing needle, said sewing needle being movably mounted on the arm means to make stitches at a sewing point on the base means, said drive means also driving a feed dog on the base means adjacent the sewing point which engages the workpiece and performs repetitive strokes, thereby moving the workpiece past said sewing point in said downstream direction;

edge sensing means on the base means, located a predetermined distance upstream of said sewing point for sensing the downstream passage of such trailing edge, and generating edge sensing signals in response thereto;

stroke sensing means on the base means for sensing the length of said strokes of the feed dog and generating stroke length signals which are indicative of said stroke length and of the length of said stitches;

stopping means on the base means for being actuated to engage the workpiece to stop its movement when the sewing needle is at the predetermined point for terminating the seam; and control means for receiving the edge sensing signals and the stroke length signals, determining therefrom a time when the sewing needle will be at said predetermined point, and generating a stopping signal for actuating the stopping means at said time;

wherein said stroke sensing means is located in the immediate vicinity of the feed dog for directly sensing its strokes;

wherein said feed dog is driven by said drive means via linkage means and said stroke sensing means is located at least partially on one of said feed dog and said linkage means; and wherein said stroke sensing means comprises a magnet secured to one of said feed dog and said linkage means, and a Hall effect sensor secured to said base means immediately near said magnet for sensing motion of said feed dog.

2. A sewing machine as in claim 1 wherein said magnet is a samarium-cobalt magnet.

3. A sewing machine adapted for moving a workpiece in a downstream direction for sewing a seam therein, and for automatically terminating said seam at a predetermined point a selected distance from a trailing edge of said workpiece, the sewing machine comprising:

base means;

arm means mounted on the base means;

drive means, for driving a sewing needle, said sewing needle being movably mounted on the arm means to make stitches at a sewing point on the base means, said drive means also driving a feed dog on the base means adjacent the sewing point which engages the workpiece and performs repetitive strokes, thereby moving the workpiece past said sewing point in said downstream direction;

edge sensing means on the base means, located a predetermined distance upstream of said sewing point for sensing the downstream passage of such trailing edge, and generating edge sensing signals in response thereto;

stroke sensing means on the base means for sensing the length of said strokes of the feed dog and generating stroke length signals which are indicative of said stroke length and of the length of said stitches;

stopping means on the base means for being actuated to engage the workpiece to stop its movement when the sewing needle is at the predetermined point for terminating the seam; and control means for receiving the edge sensing signals and the stroke length signals, determining therefrom a time when the sewing needle will be at said predetermined point, and generating a stopping signal for actuating the stopping means at said time;

wherein said stroke sensing means is located in the immediate vicinity of the feed dog for directly sensing its strokes;

wherein said feed dog is driven by said drive means via linkage means and said stroke sensing means is located at least partially on one of said feed dog and said linkage means; and wherein said stroke sensing means comprises inductive means secured to said base means which generates a magnetic field and cooperates with a metal portion on one of said feed dog and said linkage means for sensing motion of said feed dog.

4. A sewing machine adapted for moving a workpiece in a downstream direction for sewing a seam therein, and for automatically terminating said seam at a predetermined point a selected distance from a trailing edge of said workpiece, the sewing machine comprising:

base means;

arm means mounted on the base means;

drive means, for driving a sewing needle, said sewing needle being movably mounted on the arm means to make stitches at a sewing point on the base means, said drive means also driving a feed dog on the base means adjacent the sewing point which engages the workpiece and performs repetitive strokes, thereby moving the workpiece past said sewing point in said downstream direction;

edge sensing means on the base means, located a predetermined distance upstream of said sewing point for sensing the downstream passage of such trailing edge, and generating edge sensing signals in response thereto;

stroke sensing means on the base means for sensing the length of said strokes of the feed dog and generating stroke length signals which are indicative of said stroke length and of the length of said stitches;

stopping means on the base means for being actuated to engage the workpiece to stop its movement when the sewing needle is at the predetermined point for terminating the seam; and control means for receiving the edge sensing signals and the stroke length signals, determining therefrom a time when the sewing needle will be at said predetermined point, and generating a stopping signal for actuating the stopping means at said time;

wherein said stroke sensing means comprises an optical sensor secured to said base means which senses light from the feed dog and thereby senses motion of said feed dog.

5. A sewing machine adapted for moving a workpiece in a downstream direction for sewing a seam therein, and for automatically terminating said seam at a predetermined point a selected distance from a trailing edge of said workpiece, the sewing machine comprising:

base means;

arm means mounted on the base means;

drive means, for driving a sewing needle, said sewing needle being movably mounted on the arm means to make stitches at a sewing point on the base means, said drive means also driving a feed dog on the base means adjacent the sewing point which engages the workpiece and performs repetitive strokes, thereby moving the workpiece past said sewing point in said downstream direction;

edge sensing means on the base means, located a predetermined distance upstream of said sewing point for sensing the downstream passage of such trailing edge, and generating edge sensing signals in response thereto;

stroke sensing means on the base means for sensing the length of said strokes of the feed dog and generating stroke length signals which are indicative of said stroke length and of the length of said stitches;

stopping means on the base means for being actuated to engage the workpiece to stop its movement when the sewing needle is at the predetermined point for terminating the seam; and control means for receiving the edge sensing signals and the stroke length signals, determining therefrom a time when the sewing needle will be at said predetermined point, and generating a stopping signal for actuating the stopping means at said time;

wherein said stopping means comprises a press ram in the base means adjacent the feed dog, and a servo-element for projecting the press ram above the sewing point in response to said stopping signal to raise the workpiece away from the feed dog and thereby terminate movement of the workpiece.

6. A sewing machine as in claim 5 wherein said base means comprises a throat plate having a substantially planar surface which forms part of an upper surface of said base means, said feed dog, said sewing point, and said press ram being substantially adjacent to said throat plate surface.

7. A sewing machine as in claim 6 wherein said sewing machine comprises a presser foot for holding the workpiece near the throat plate surface during sewing, and said press ram when actuated presses the workpiece against the presser foot.

8. A sewing machine as in claim 5, wherein an upper surface of said press ram has a rough surface for engaging the workpiece.

9. A sewing machine as in claim 5 wherein the stopping means further comprises a lever pivotally mounted at a pivot point in said base means in said upstream direction from said press ram, and below said throat plate surface;

said servo-element, when actuated, raising the downstream end of said lever; and said press ram being located for being projected upward by said raising of the downstream end of the lever so as to engage the workpiece.

10. A sewing machine as in claim 9 further comprising limit means for limiting the upward projection of said recess ram.

11. A sewing machine as in claim 5 wherein the servo-element comprises a cylinder which is actuable by pressure fluid, and a solenoid valve which receives said stopping signal for controlling a source of such pressure fluid to said cylinder.

12. A sewing machine as in claim 11 wherein said cylinder is vertically displaceably mounted in said base means.

13. A sewing machine as in claim 9, wherein the servo-element comprises a cylinder which is actuable by pressure fluid, and a solenoid valve which receives said stopping signal for controlling a source of such pressure fluid to said cylinder.

14. A sewing machine as in claim 13 wherein said cylinder is vertically displaceably mounted in said base means.

15. A sewing machine as in claim 5 wherein the servo-element comprises an electromagnet which receives said stopping signal.

16. A sewing machine as in claim 15, wherein said electromagnet is vertically displaceably mounted in said base means.

17. A sewing machine as in claim 9 wherein the servo-element comprises an electromagnet which receives said stopping signal.

18. A sewing machine as in claim 17 wherein said electromagnet is vertically displaceably mounted in said base means.

19. A stitch length sensing system for a sewing machine adapted for moving a workpiece in a downstream direction for sewing a seam therein, the sewing machine comprising:

base means;

arm means mounted on the base means;

drive means, for driving a sewing needle, said sewing needle being movably mounted on the arm means to make stitches at a sewing point on the base means, said drive means also driving a feed dog on the base means adjacent the sewing point which engages the workpiece and performs repetitive strokes, thereby moving the workpiece past said sewing point in said downstream direction; said stitch length sensing system comprising stroke sensing means on the base means for sensing the length of said strokes of the feed dog and generating stroke length signals which are indicative of said stroke length, and thereby sensing the length of said stitches;

wherein said stroke sensing means is located in the immediate vicinity of the feed dog for directly sensing its strokes;

wherein said feed dog is driven by said drive means via linkage means and said stroke sensing means is located at least partially on one of said feed dog and said linkage means; and wherein said stroke sensing means comprises a magnet secured to one of said feed dog and said linkage means, and a Hall effect sensor secured to said base means immediately near said magnet for sensing motion of said feed dog.

20. A system as in claim 19, further comprising means for receiving the stroke length signals and generating therefrom further signals indicative of said stitch length.

21. A system as in claim 19, wherein said magnetic is a samarium-cobalt magnet.

22. A stitch length sensing system for a sewing machine adapted for moving a workpiece in a downstream direction for sewing a seam therein, the sewing machine comprising:

base means;

arm means mounted on the base means; and drive means, for driving a sewing needle, said sewing needle being movably mounted on the arm means to make stitches at a sewing point on the base means, said drive means also driving a feed dog on the base means adjacent the sewing point which engages the workpiece and performs repetitive strokes, thereby moving the workpiece past said sewing point in said downstream direction; said stitch length sensing system comprising stroke sensing means on the base means for sensing the length of said strokes of the feed dog and generating stroke length signals which are indicative of said stroke length, and thereby sensing the length of said stitches;

wherein said stroke sensing means is located in the immediate vicinity of the feed dog for directly sensing its strokes;

wherein said feed dog is driven by said drive means via linkage means and said stroke sensing means is located at least partially on one of said feed dog and said linkage means; and wherein said stroke sensing means comprises inductive means secured to said base means which generates a magnetic field and cooperates with a metal portion on one of said feed dog and said linkage means for sensing motion of said feed dog.

23. A stitch length sensing system for a sewing machine adapted for moving a workpiece in a downstream direction for sewing a seam therein, the sewing machine comprising:

base means;

arm means mounted on the base means; and drive means, for driving a sewing needle, said sewing needle being movably mounted on the arm means to make stitches at a sewing point on the base means, said drive means also driving a feed dog on the base means adjacent the sewing point which engages the workpiece and performs repetitive strokes, thereby moving the workpiece past said sewing point in said downstream direction; said stitch length sensing system comprising:

stroke sensing means on the base means for sensing the length of said strokes of the feed dog and generating stroke length signals which are indicative of said stroke length, and thereby sensing the length of said stitches;

wherein said stroke sensing means comprises an optical sensor secured to said base means which senses light from the feed dog and thereby senses motion of said feed dog.

24. A sewing machine as in claim 1, wherein said edge sensing means comprises first and second sensors mounted in predetermined locations on said base means, said first sensor being directly upstream of said sewing point, and said second sensor being located upstream of said first sensor, and displaced by a predetermined distance from said first sensor in a direction transverse to said upstream direction.

25. A workpiece stopping system for a sewing machine adapted for moving a workpiece in a downstream direction for sewing a seam therein, and for terminating said seam at a predetermined point, the sewing machine comprising:

base means;

arm means mounted on the base means; and drive means, for driving a sewing needle, said sewing needle being movably mounted on the arm means to make stitches at a sewing point on the base means, said drive means also driving a feed dog on the base means adjacent the sewing point which engages the workpiece and performs repetitive strokes, thereby moving the workpiece past said sewing point in said downstream direction; said workpiece stopping system comprising:

stopping means on the base means for being actuated to engage the workpiece to stop its movement when the sewing needle is at the predetermined point for terminating the seam; and control means for detecting a time when the sewing needle will be at said predetermined point, and generating a stopping signal for actuating the stopping means at said time;

wherein said stopping means comprises a press ram in the base means adjacent the feed dog, and a servo-element for projecting the press ram above the sewing point in response to said stopping signal to raise the workpiece away from the feed dog and thereby terminate movement of the workpiece.

26. A sewing machine as in claim 25 wherein the stopping means further comprises a lever pivotally mounted at a pivot point in said base means upstream from said press ram and below said throat plate;

said servo-element, when actuated, raising the downstream end of said lever; and said press ram being located for being projected upward by said raising of the downstream end of the lever so as to engage the workpiece.

27. A system as in claim 22, further comprising means for receiving the stroke length signals and generating therefrom further signals indicative of said stitch length.

28. A sewing machine as in claim 3, wherein said edge sensing means comprises first and second sensors mounted in predetermined locations on said base means, said first sensor being directly upstream of said sewing point, and said second sensor being located upstream of said first sensor, and displaced by a predetermined distance from said first sensor in a direction transverse to said upstream direction.

* * * * *